United States Patent [19]

Minowa

[11] 4,113,391

[45] Sep. 12, 1978

[54] METHOD FOR CONTROLLING VOLTAGE AND PROVIDING TEMPERATURE COMPENSATION IN A THERMAL PRINTER

[75] Inventor: Masahiro Minowa, Shiojiri, Japan

[73] Assignees: Kabushiki Kaisha Suwa Seikosha, Tokyo; Shinshu Seiki Kabushiki Kaisha, Suwa, both of Japan

[21] Appl. No.: 736,046

[22] Filed: Oct. 27, 1976

[30] Foreign Application Priority Data

Oct. 27, 1975 [JP] Japan ..... 50-129019

[51] Int. Cl.[2] ..... B41J 1/24; B41J 3/20; G08B 23/00

[52] U.S. Cl. ..... 400/120; 400/578; 219/216; 219/483; 346/76 R

[58] Field of Search ..... 197/1 R, 127 R, 133 R; 101/93.04, 93.01; 219/216, 504, 505, 483; 346/76 R; 340/324 R, 324 M, 248 A, 248 B, 248 C, 249 P, 210, 227 R, 227 D; 235/150, 151.21, 151.22

[56] References Cited

U.S. PATENT DOCUMENTS

| | | | |
|---|---|---|---|
| 3,577,137 | 5/1971 | Brennan, Jr. | 219/216 X |
| 3,754,278 | 8/1973 | Borden, Jr. | 346/76 R |
| 3,777,116 | 12/1973 | Brescia et al. | 346/76 R |
| 3,805,022 | 4/1974 | Kulwicki et al. | 219/504 X |
| 3,810,192 | 5/1974 | Okabe | 346/76 R X |
| 3,813,677 | 5/1974 | Shimotsuma | 219/216 X |
| 3,820,099 | 6/1974 | Vogt | 340/248 B X |
| 3,842,243 | 10/1974 | Gregory | 219/505 X |
| 3,845,850 | 11/1974 | Herr et al. | 197/1 R |
| 3,874,493 | 4/1975 | Boyd | 346/76 R X |
| 3,913,091 | 10/1975 | Aizawa et al. | 346/76 R |
| 3,917,993 | 11/1975 | Picmaus et al. | 219/505 X |
| 3,921,162 | 11/1975 | Fukai et al. | 219/216 X |
| 3,934,695 | 1/1976 | Kovalick | 197/1 R |
| 3,975,707 | 8/1976 | Matsutoshi | 219/216 X |
| 3,975,742 | 8/1976 | Kelley | 197/1 R X |
| 3,996,581 | 12/1976 | Brodeur et al. | 197/1 R X |
| 4,004,672 | 1/1977 | Hirano et al. | 197/1 R |
| 4,027,761 | 6/1977 | Quaif | 197/1 R |
| 4,030,588 | 6/1977 | Hanagata et al. | 197/1 R |
| 4,032,925 | 6/1977 | Kos | 219/216 X |
| 4,038,516 | 7/1977 | Bergvall | 219/505 X |

*Primary Examiner*—E. H. Eickholt

*Attorney, Agent, or Firm*—Blum, Moscovitz, Friedman & Kaplan

[57] ABSTRACT

A method and apparatus is provided for controlling the period or pulse width of pulses applied to exothermic printing elements of a thermal printer to effect printing. Control of the period or pulse width is in response to variations in applied voltage and ambient temperature. A pulse generator for this purpose may include such elements as a varistor, a constant voltage element and a thermistor.

14 Claims, 13 Drawing Figures

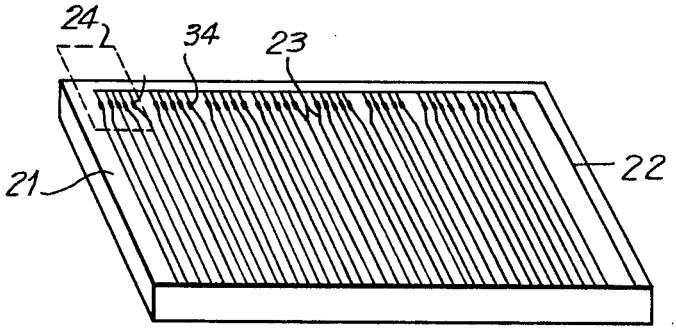
FIG. 2
PRIOR ART
FIG. 3
PRIOR ART
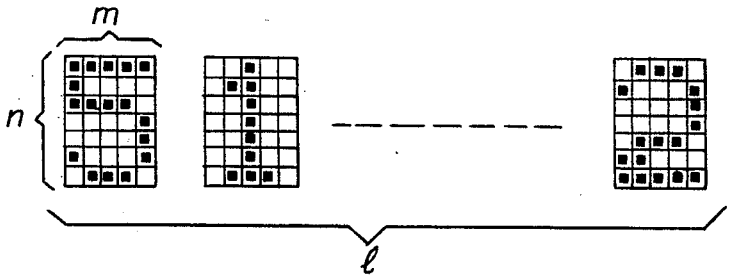

METHOD FOR CONTROLLING VOLTAGE AND PROVIDING TEMPERATURE COMPENSATION IN A THERMAL PRINTER

BACKGROUND OF THE INVENTION

Generally speaking, this invention relates to thermal printers characterized by having exothermic printing elements driven by pulses of current which heat the exothermic elements to effect printing. In the art, such conventional thermal printing units are provided with a central processing unit which performs calculations and other functions and a printer control unit which controls the application of pulses to the exothermal printing elements in response to the signals received from the central processing unit. Generally, in the art, timing for clocking the central processing unit and for controlling the frequency and period of the printing pulses is controlled by a single oscillator. Since such thermal printers are frequently used in conjunction with battery-driven devices, and since the voltage of battery voltage sources varies with time, it was necessary to provide voltage regulator circuitry for stabilizing the voltage applied to the exothermic elements to effect printing. Voltage stabilization is generally selected at a level below the minimum voltage to which the battery may fall, thereby not efficiently using the full power available to the device.

Further, if the voltage regulator is damaged, a higher voltage than the voltage for which the exothermic printing elements are designed is applied to such exothermic printing elements, consequently resulting in the burning and damaging thereof. For this reason, the conventional thermal printers suffered from inferior reliability.

A further difficulty arises from the fact that the prior art thermal printers were frequently manufactured by entities different from the manufacturers of the electronic table calculators to which they were to be joined and were adapted to operate at different predetermined applied voltages, making proper operation of the prior art thermal printers more difficult and more expensive. A further difficulty in thermal printers is unevenness of printing due to variations in operating temperature due to variations in ambient temperature.

The foregoing difficulties in the prior art are avoided by providing a thermal printer wherein the pulse width of the signal applied to the exothermic printing elements is controlled in response to input voltage and ambient temperature.

SUMMARY OF THE INVENTION

Generally speaking, in accordance with the invention, a thermal printer is provided having exothermal printing elements adapted to be energized in response to pulses of current applied thereto. Control circuit means is provided for controlling the width of the driving pulses applied to said exothermic driving elements. Said control circuit means may consist of a pulse generation circuit including means for varying the period of the pulses produced thereby in response to the voltage applied thereto. Said pulse generation circuit may include a free-running multivibrator having a varistor in one RC circuit thereof. The thermal printer includes a printer control unit for selectively applying driving pulses to said exothermic printing element, said pulse generation circuit being coupled to control the pulse width of said driving pulses.

Said pulse generation circuit may also include means responsive to variations in ambient temperature for adjusting the pulse width in response to such changes in ambient temperature. Said temperature sensitive means may include thermistor means mounted on the base plate supporting said exothermic printing elements.

Said supply voltage may be applied to said pulse generation circuit through a constant voltage element and said thermistor means may be positioned intermediate said constant voltage element and said pulse generation circuit.

Accordingly, it is an object of this invention to provide a method and apparatus for obtaining stable print quality in a thermal printer despite variations in supply voltage and ambient temperature.

Another object of the invention is to provide a pulse generation circuit which can vary the driving pulse applied to the exothermic printing elements of a thermal printer in response to variations in supply voltage and ambient temperature.

A further object of the invention is to provide a circuit for protecting an exothermic printing element from abnormally high voltages.

Still a further object of the invention is to provide a method and apparatus for controlling a thermal printer which permits operation with low power consumption yet maximizes the efficiency of use of the available supply voltage.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a perspective view of a thermal printer head on which is disposed exothermic printing elements;

FIG. 3 is a schematic representation of the printing method effected by the thermal printing head of FIG. 2;

DESCRIPTION OF THE PREFERRED EMBODIMENTS

Figure 1:
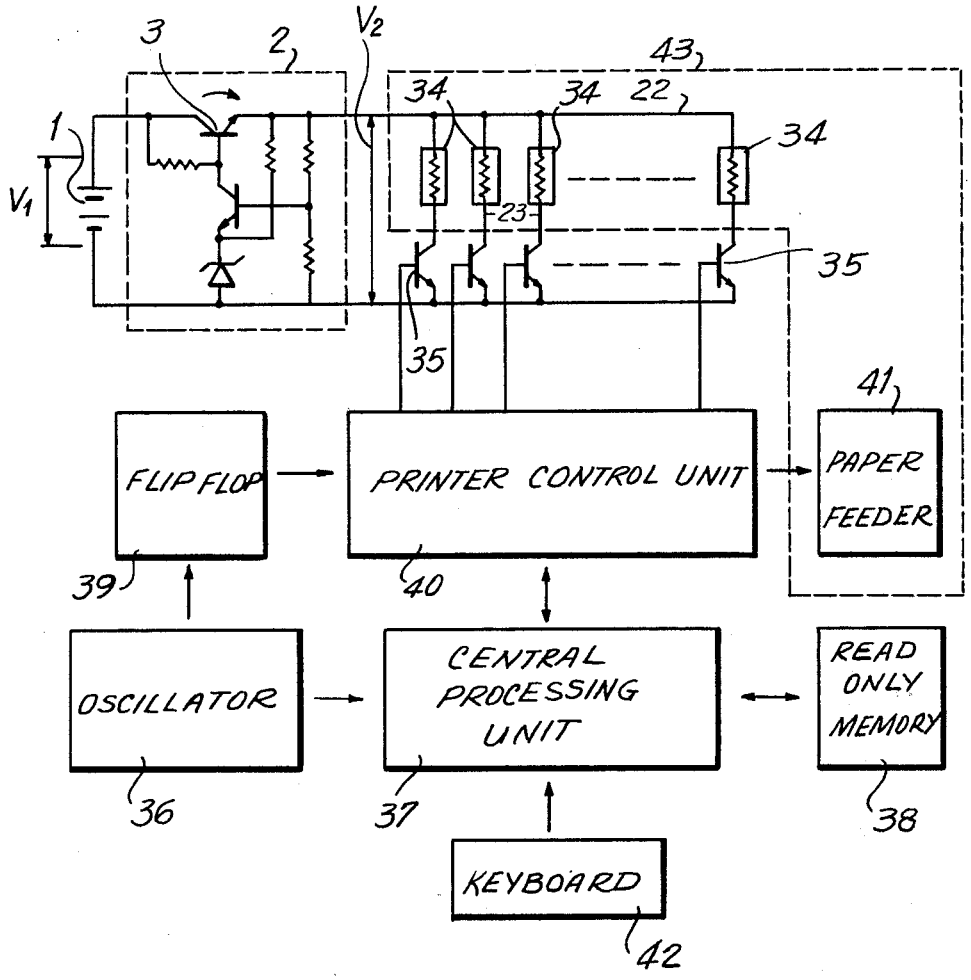
FIG. 1 PRIOR ART
FIG. 1 is a circuit and block diagram of an electronic table calculator incorporating the voltage regulation arrangement for thermal printers of the prior art.

Referring now to FIG. 1, a conventional thermal printer is depicted incorporated in an electronic table calculator. Both the calculator and thermal printer are driven by a conventional power source 1 which may take the form of a dry cell, a Ni-Cd battery or a rectified commercial alternating power source. Said power source produces a voltage $V_1$ which may vary as more particularly described below. In order to avoid the effect of such variations in voltage source, a voltage regulator 2 is provided for producing a fixed voltage $V_2$ in response to the application of voltage $V_1$ thereto. The voltage regulator circuit 2 is of conventional design incorporating a power transistor 3. The output of voltage regulator 2 is applied to power the printing head of a thermal printer. Specifically, the printing head includes an array of exothermic printing elements 34 each connected in series with a feed transistor 35, said series connection being connected to receive the voltage $V_2$. The actual application of driving current to the respective exothermic printing elements is controlled by the gating of the respective transistors 35 by a printer control unit 40. The table electronic calculator includes an oscillator 36 which produces clock pulses which are applied to regulate the operation of a central processing unit 37 in which arithmetic and other functions are performed. Data is applied to the central processing unit by keyboard 42. The central processing unit is coupled to a read only memory 38 for performing the memory functions of the calculator. Since the exothermic elements are driven by pulses of current, the duration of the pulses, namely the duration of the signal applied to the respective gates of transistors 35, is governed by a flip-flop 39 which is, in turn, driven by oscillator 36 which determines the period thereof. Thus, flip-flop 39 determines the period of the pulses and printer control unit 40 determines which of the exothermic elements are to be actuated as determined by the signal received from the central processing unit 37. The printer control unit also controls a paper feeder 41, paper feeder 41 and exothermic elements 34 generally being formed as a unit to define what is generally accepted to be the "thermal printer" 43.

In operation, the signal input by keyboard 12 is operated on in the central processing unit 37 in conjunction with read only memory 38 to transmit a signal to printer control unit 40 representative of the characters to be printed. The printer control unit 40 controls the respective feed transistors 35 and paper feeder 41 to print the designated characters, numerals, and the like.

Referring to FIG. 2, one embodiment of a thermal printing head is depicted. The head consists of a substrate 21 formed of an insulator such as ceramics or glass on which exothermic elements 34 are disposed in a line pattern as more particularly described below. One side of each of the exothermic elements are connected in common to a common electric conductor 22 which is in turn connected to one end of the power source (voltage $V_2$, by way of example). The other end of each of said exothermic printing elements is connected to a conductor 23 for connection to the collector of a feed transistor 35. The exothermic elements are arranged in groups 24 consisting of five adjacent exothermic elements, the respective groups being spaced from each other, each group being utilized to form a single character. The method of forming characters is illustrated in connection with FIG. 3 wherein $l$ characters are produced side-by-side by the thermal printer. Each character is defined by a matrix $m$ wide and $n$ small. Where $l$ figures are required, the number of exothermic elements required are $m \times l$. In the case of the print head of FIG. 2, $m = 5$ and $l = 8$ so that 40 exothermic elements are necessary. In the embodiments of FIG. 3, $n = 7$ so that a seven-step operation is required to print characters in a single line using the print head of FIG. 2, each step requiring an advance of the paper feeder 41. It should be noted that while a $5 \times 7$ matrix is depicted, the arrangement in accordance with the invention can apply equally to other forms of printing matrixes including seven-bar displays and the like.

In the circuit of FIG. 1, oscillator 36 is formed of a circuit having a relatively stable frequency, which frequency is divided by flip-flop 9 to determine the conducting time of the respective exothermic printing elements 34. Where power source 1 is characterized by variations in voltage, as where a dry cell is used as a power source, the voltage regulator is required in order to maintain constant heat capacity of the exothermic printing elements 34. By way of example, where dry cells are used, the device is usually operated within the range of 1.5 volts to 1 volt per cell, so that if eight dry cells in series are utilized as a power source 1, the supply voltage $V_1$ may change from 12 volts to 8 volts.

In recognition of the foregoing voltage variations, the predetermined voltage $V_2$ on the secondary side of the regulator must be selected at about 5 volts, a voltage less than the minimum voltage $V_1$. Accordingly, the use of the voltage regulator 2 causes a waste in power, principally due to the losses at the collector of the power transistor 3. Such losses provide a material disadvantage where power sources of limited capacity, such as batteries are used. This becomes particularly significant where portable electronic calculators are provided. Further, if regulator 2 is damaged by an abnormality, the voltage applied to the exothermic elements 34 increases markedly, creating the possibility of burning and damage thereto. Further, where the thermal printer and electronic table calculator are manufactured by different entities, there is a lack of coordination between the conducting time as determined by oscillator 36 and flip-flop 39 and the supply voltage, causing unevenness of printing.

Figure 4:
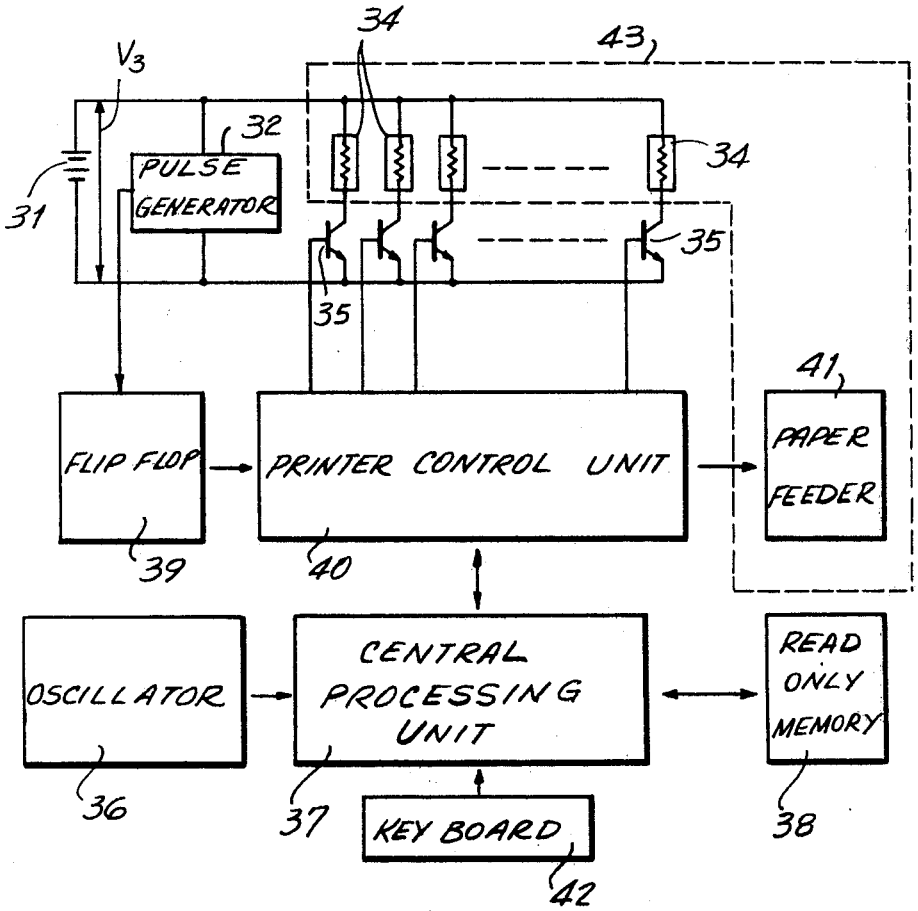
FIG. 4 is a circuit and block diagram of an electronic table calculator embodying the controlling method for thermal printers in accordance with the invention.

Referring now to FIG. 4, an electronic table calculator incorporating a thermal printer in accordance with the invention is depicted, like reference numerals having been applied to like elements in FIGS. 3 and 4. In the circuit of FIG. 4, the voltage regulator 3 has been replaced by a pulse generator 32, the voltage output $V_3$ of power source 31 being applied directly across the series connection of exothermic printing elements 34 and feed transistors 35. As more particularly discussed below, pulse generator 32 is adapted to detect the voltage level $V_3$ of of power source 31 and to produce a pulse the width or period of which is representative of the applied voltage. The pulse output of pulse generator 32 is applied to control flip-flop 39, which in turn regulates the width of the driving pulses applied to the respective gates of the transistors 35 to effect energizing of the exothermic elements to effect printing. Accordingly, pulse generator 32 controls the conducting time of exothermic printing elements 34 and serves as the clock pulse generator for printer control unit 40. The clock pulse for the central processing unit 37 is still provided by oscillator 36.

Figure 5:
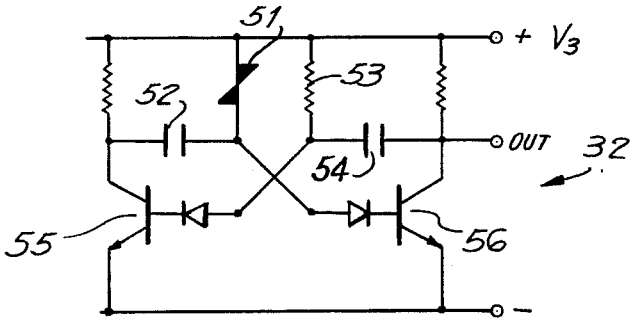
FIG. 5 is a circuit diagram of one embodiment of the pulse generation circuit in accordance with the invention.

Referring now to FIG. 5, one embodiment of the pulse generator 32 is depicted. Pulse generator 32 is in the nature of a free-running multivibrator with transistors 55 and 56 being alternately rendered conductive and non-conductive depending on the time constant of the respective RC circuit associated therewith. Specifically, the time constant $\tau_1$ determined by capacitor 52 and varistor 51 controls the operation of transistor 56 while the time constant $\tau_2$ represented by resistance 53 and capacitor 54 controls the operation of transistor 55. The transistors 55 and 56 are alternately turned ON and OFF in response to the respective gate voltages thereof as determined by the respective time constant. In this manner, the time constants determine the period of the pulse output of pulse generator 32.

Figure 6:
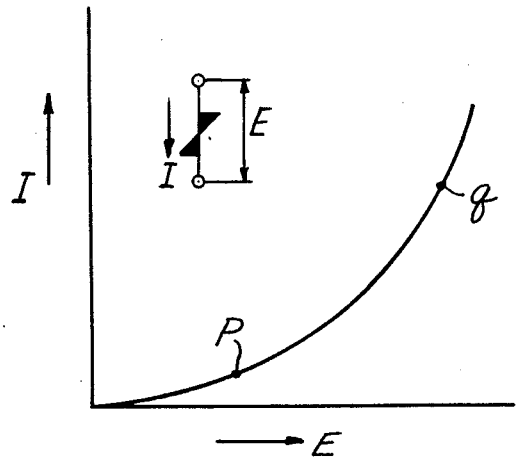
FIG. 6 is a graphical representation of the voltage-current characteristic of a varistor in accordance with the invention.

Referring to FIG. 6, the voltage-current characteristic of varistor 51 is depicted, wherein E represents the applied voltage to the varistor and I represents the current flow. The varistor is characterized by a resistance which varies inversely to the applied voltage so that as the applied voltage increases, the resistance decreases. In the case of the circuit of FIG. 5, the voltage applied to the varistor is the voltage $V_3$ from the power source. As the power source voltage increases, the period of the output pulses decreases due to the operation of varistor 51 and the altering of the time constant controlling the operation of transistor 56. Similarly, as the voltage of the power source decreases, the period of the output pulses of pulse generator 32 increases.

A further feature of the arrangement in accordance with the invention is the provision of a thermistor as part or all of resistors 51 or 53, which thermistor is characterized by a variation in resistance with temperature. Since thermal printers are generally affected by ambient temperature, a thermistor having a negative characteristic is utilized in combination with either the varistor 51 or fixed resistor 53 so that the period of the pulse output of pulse generator 32 is relatively short at high temperatures while the pulse width of the pulse output is relatively long at low temperatures. In this manner, the conducting time of the exothermic elements 34 is adjusted so as to obtain proper printing quality.

Figure 7:
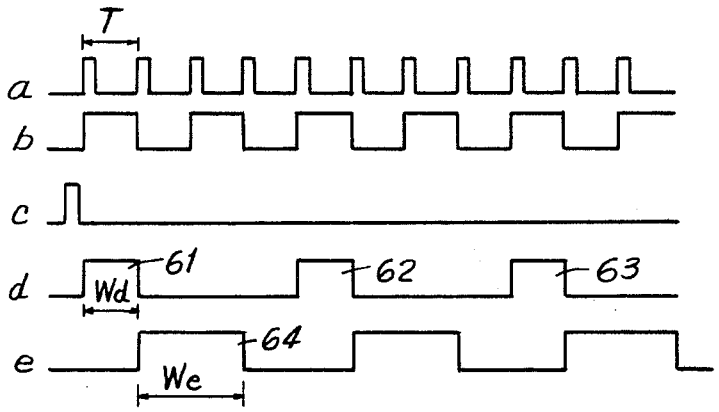
FIG. 7 is a waveform diagram illustrating the controlling method for thermal printers in accordance with the invention.

Referring now to FIG. 7, a timing chart for the thermal printer 43 of the electronic table calculator of FIG. 4 is depicted. Waveform *a* represents the output waveform of pulse generator 32, which oscillates at a period T which depends on the level of the applied voltage from the voltage source, and, if desired, on variations in ambient temperature. Waveform *b* represents the output of flip-flop 39, namely the output of pulse generator 32 divided by a predetermined amount to produce a suitable clock pulse for the printer control unit. Waveform *c* represents a printing order transmitted to the printer control unit 40 by the central processing unit 37, as in response to an entry in keyboard 42. Waveform *d* illustrates the printing head conduction controlling pulse which predetermines the conducting time of the respective exothemic elements 34 and the position thereof in a given cycle of operation. Waveform *e* represents the waveform of the signal applied to energize the paper feeder 41 intermediate respective energizations of the selected exothermic elements.

The conducting time $W_d$ necessary to effect printing of the first line in the $m \times n$ matrix of FIG. 3 is determined by the printing head conduction controlling pulse 61. Similarly, pulse 62 determines the time for the second line of the matrix while pulse 63 governs the conduction time for the third line. In like manner, pulses are produced until the *n*th line has been printed. At this time, printing of a given character has been effected. The period during which the power source of the paper feeder is driven is determined by the conducting time $W_e$, which also determines the period during the cycle that paper feed is effected. In general, the power source for a paper feeder is either a plunger, in the nature of a solenoid, or a step motor. In the arrangement of FIG. 7, the printing head conduction controlling pulses as represented by waveform *d* and the paper feeder power source conduction controlling pulses represented by waveform *e* are both in synchronism with the output of pulse generator 32 as represented by waveform *a* of FIG. 7. Accordingly, not only does conduction time but printing speed varies with changes in voltage.

Figure 8:
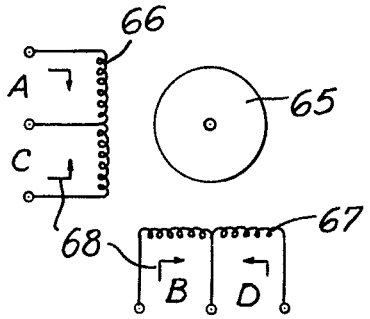
FIG. 8 is a schematic representation of a step motor utilized in a thermal printer.

Referring to FIG. 8, one embodiment of a step motor utilized to drive a paper feeder is schematically depicted. In this embodiment, the step motor is provided with a rotor 65 and driving coils 66 and 67 of conventional design, said driving coils being provided with center taps to define coils of four phases A, B, C and D. The rotor 65 is rotated at a fixed rotational angle by successively rendering the four coil phases conductive in the direction designated by arrows 68, so that the four coil phases are rendered conductive in the following order: A, B, C, D.

Figure 9:
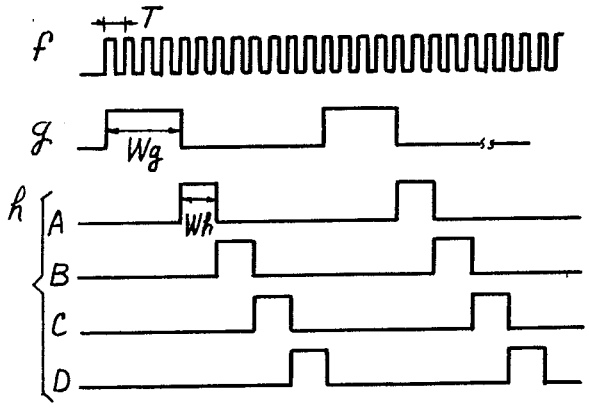
FIG. 9 is a waveform diagram of a thermal printer in accordance with the invention incorporating the step motor of FIG. 8.

Referring to FIG. 9, a timing chart for driving a step motor embodiment of the type of FIG. 8 is depicted. Waveform *f* represents the output waveform of a pulse generator 32 having a period T. Waveform *g* represents the waveform of the printing head conduction controlling pulses which control the period of conduction of the exothermic elements 34. Waveforms *h* represent the respective conduction controlling pulses of the step motor, the respective signals applied to each of the phases A, B, C and D being separately identified, each of the phase conduction controlling pulses being of a width $W_h$. The number of phase conduction control pulses applied to the step motor of the paper feeder depends on the amount of paper advance required between printing head conduction controlling pulses. In this connection, it is noted that the timing chart of FIG. 7 is more closely related to the timing chart of a plunger actuated paper feeder.

In conventional voltage controlling arrangements for thermal printers, the conducting time of the driving signal to the paper feeding plunger or step motor is fixed. However, in the arrangement in accordance with the invention, the conducting time of the driving signals of the power supply of the paper feeder varies as the supply voltage changes. This is important since, in general, the plungers and step motors are characterized by the property that the response speed is high if the supply voltage is high. However, in the case of a high voltage, almost all of the electric energy is lost as heat dissipation in the power source (plunger or step motor) even if the conducting time is expanded beyond the fixed time. For this reason, in conventional thermal printers, the failure to adequately dissipate the excessive heat generated in the step motor, plunger or other power source may cause the apparatus to burn or otherwise be damaged due to the rise in temperature upon the application of high voltages. This defect is avoided by the arrangement in accordance with the invention since the conducting time of the driving signal to the power source of the paper feeder varies with the supply voltage, thereby limiting the temperature rise occasioned in such power sources. In this manner, high reliability and security can be achieved. Accordingly, in the arrangement in accordance with the invention, the conducting time of the driving signal to the paper feeder is relatively short at high voltages and relatively long at low voltages, an arrangement which also contributes to the efficient use of the available power to permit long-term driving of the thermal printer at low power consumption.

Figure 10:
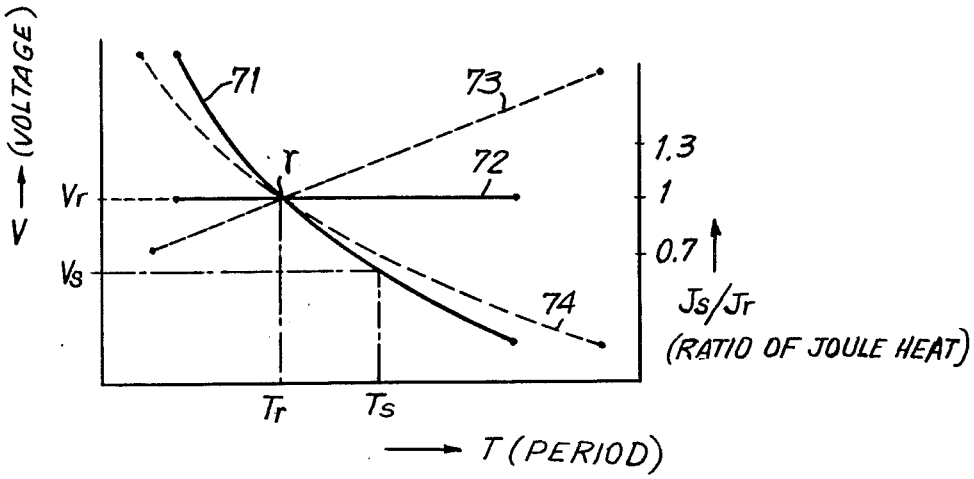
FIG. 10 are graphical representations of the period-voltage characteristics and period-ratio of Joule heat characteristics of the pulse generation circuit of FIG. 5 and of a more ideal pulse generation circuit.

Referring again to FIG. 6, two points selected on the characteristic curve of the varistor, points $p$ and $q$ are arbitrary points selected for the purposes of illustration. The current values at said points are $I_p$ and $I_q$ respectively and the voltage values at said points are $E_p$ and $E_q$ respectively. The characteristic of varistor 51 may generally be expressed by the following:

$$E = K I \beta,$$

wherein $K$ and $\beta$ are constants. $\beta$ may be expressed as follows, utilizing the above-defined current and voltage values at the arbitrary points $p$ and $q$:

$$\beta = \log (E_q/E_p)/\log (I_q/I_p)$$

Where the varistor is characterized by a $\beta$ of $0.3 \sim 0.38$ and the supply voltage is, for example, about 24 volts, the relationship between the period T and the voltage V of the pulse generation circuit of FIG. 5 is represented by the characteristic curve 71 depicted in FIG. 10. This characteristic curve varies slightly due to the variation of the capacitor. The central value of the input voltages applied to the pulse generator and thermal printer 43 may be taken as $V_r$, the point $r$ on the characteristic curve 71 at which such voltage occurs corresponding to a period $T_r$.

Where the Joule heat at the time that an exothermic element 34 is rendered conductive is J, the resistance value of the exothermic element 34 is $R_{34}$, the voltage applied across the exothermic element is V and the pulse width during which the exothermic element is conducting is $W_d$ (in proportion to the period T), the Joule heat J may be expressed as follows:

$$(V^2 \times W_d) / R_{34} = J$$

Theoretically, if the Joule heat J is uniform, a fixed level of thermal heat is added to the exothermic element 34 and uniform printing quality results. Experimentation has revealed that the pulse generator circuit 32 of FIG. 5 permits the establishment of a uniform Joule heat through selection of the resistors and capacitors and the use of a varistor 51 having a $\beta = 0.3 \sim 0.38$.

If a second arbitrary point on characteristic curve 71 of FIG. 10 is selected to be S, the Joule heat at that point is $J_S$ and the Joule heat at point $r$ is $J_r$. The relation $J_S/J_r$ is depicted by line 72 in FIG. 10. Line 72 is essentially straight. Causing the conducting time of the exothermic elements 34 to change along characteristic curve 71 is based on the assumption that a uniform thermal capacity is applied and that the characters and symbols are thus printed with uniform printing quality. However, in actual printing, experience has shown that the printed character id darker at voltages higher than $V_r$ and lighter at voltages lower than $V_r$. As a result of experimentation, it has been found that a period-ratio of Joule heat characteristic curve of the type represented by dashed line 73 in FIG. 10 avoids the foregoing difficulty of uneven printing quality. Line 73 is characterized by the ratio of Joule heat $J_S/J_r$ increasing as the period T increases.

It is believed that the uneven printing quality is caused by an increase in the escape of thermal heat to the substrate and ambience as the conducting period $W_d$ increases. The relationship between the period T and the voltage V which satisfies the characteristic curve 73 is shown by the characteristic curve 74 in FIG. 10.

Figure 11:
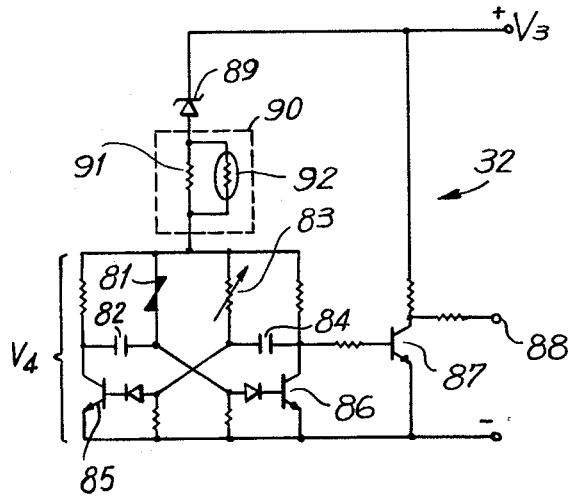
FIG. 11 is a circuit diagram of a second embodiment of the pulse generation circuit in accordance with the invention.

Referring now to FIG. 11, the embodiment of the pulse generator 32' depicted satisfies the requirements of characteristic curve 74 of FIG. 10. Specifically, the circuit is characterized by a free-running multivibrator having a varistor 81 and capacitor 82 controlling the gate of transistor 86 and a variable resistor 83 and a capacitor 84 controlling the gate of transistor 85. The free-running multivibrator circuit of FIG. 11 operates in the same manner as the circuit of FIG. 5. Variable resistor 83 permits selective adjustment of the conduction period of the exothermic printing elements. However, the voltage of the voltage source is not applied directly to the free-running multivibrator, but rather, the voltage $V_3$ is applied through a constant voltage element, namely Zener diode 89 and a resistance element 90, said Zener diode and resistance element 90 being connected in series so that a voltage $V_4$ appears across the free-running multivibrator. The output of the free-running multivibrator is applied to a transistor 87 which serves to shape the waveform of the output of the multivibrator to apply said output to terminal 88.

Resistance element 90 is depicted as consisting of the parallel combination of a fixed resistor 91 and a thermistor 92. However, in accordance with the invention, a thermistor may be used alone, the thermistor may be placed in series with the fixed resistor or, if temperature compensation is not required, resistance element 90 may be eliminated completely.

The pulse generation circuit of FIG. 5 is characterized by a rate of change of the period of the output pulse signal determined by the rate of change of the applied voltage. The circuit of FIG. 11 is characterized by the characteristic curve 74. This is achieved by the insertion of Zener diode 89 intermediate voltage source $V_3$ and the free-running multivibrator (the point at which the voltage is $V_4$). The provision of the Zener diode 89 increases the rate of change of the voltage applied to the free-running multivibrator. Thus, in the case where the center value of the voltage applied from the power source to the thermal printer 43 is $V_r$ and the Zener voltage of the Zener diode is $V_z$, $V_r$ being 20 volts, $V_z$ being 10 volts, and further, the voltage of the power source changes to a level $V_s$ equal to 18 volts, the rate of change $\rho_1$ of the voltage may be expressed as follows:

$$\rho_1 = (V_r - V_s)/(V_r - V_z) = (20 - 18)/(20 - 10) = 0.2$$

In the absence of the Zener diode, the rate of change $\rho_2$ is expressed as follows:

$$\rho_2 = (V_r - V_3)/V_r = 0.1$$

From the above, it can be understood that the rate of change $\rho_1$ is higher than the rate of change $\rho_2$. When the rate of change of the voltage is high, the rate of change of the period of the pulse generation circuit becomes high, so that the characteristic curve 71 which characterizes FIG. 5 is displaced in the direction of the characteristic curve 74 of FIG. 10. From the foregoing it is also apparent that the rate of change of the period can be increased by raising the voltage $V_z$ of the Zener diode. In general, a Zener diode may be utilized as the constant voltage element, but plural diodes for rectification connected in the forward direction may also serve as the constant voltage element. The value of the Zener diodes $V_z$ and the resistance of resistance 90 are selected to provide the desired characteristic curve for achieving the beneficial results in accordance with the invention.

Figure 12:
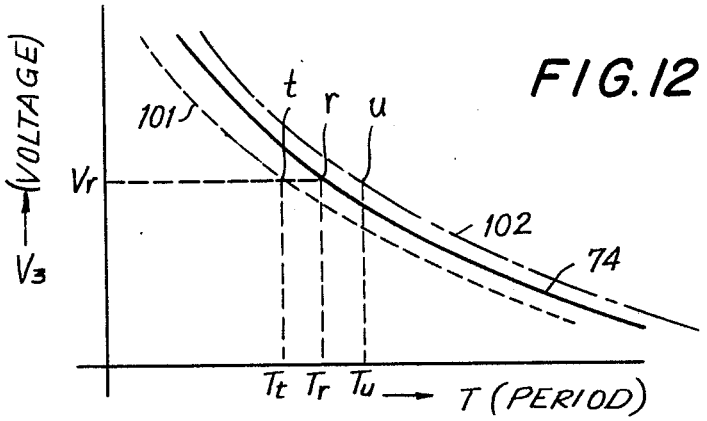
FIG. 12 is a graphical representation of the period-voltage characteristic of the pulse generation circuit of FIG. 11 with variations in temperature.

Referring now to FIG. 12, the temperature characteristic of the output signal of pulse generator circuit 32 of FIG. 11 is depicted. Curve 74 represents the characteristic curve of period versus voltage at a normal temperature. Curve 101 illustrates the displacement of the characteristic curve when the ambient temperature is about 50° C., while curve 102 represents the characteristic curve when the ambient temperature is below about 0° C. As is illustrated in FIG. 12, at a voltage $V_r$, the point *r* on characteristic curve 74 transfers to point *t* on curve 101 and point *u* on curve 102. In this manner, the conducting time of the exothermic printing element changes in response to temperature such that the conducting time is decreased at high ambient temperatures and increased at low ambient temperatures. In this manner, stable printing quality can be obtained.

Figure 13:
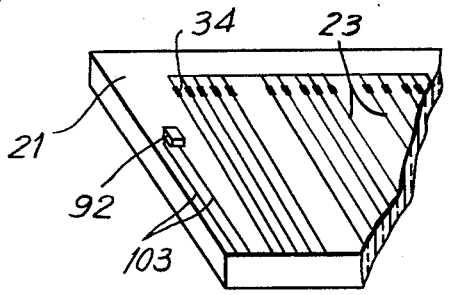
FIG. 13 is a fragmentary perspective view of a thermal printing head incorporating a temperature-sensitive thermistor in accordance with the invention.

It is noted that resistance element 90 including thermistor 92 can be incorporated in resistor 83. It is also noted that, as illustrated in FIG. 13, thermistor 92 may be mounted on the substrate 21 of the thermal printing head so as to detect the temperature of the substrate to insure accurate temperature compensation in the actuation of the exothermic printing elements 34. The thermistor 92 may be connected to the circuit of FIG. 11 by means of conductors 103.

The method and apparatus in accordance with the invention produce stable printing quality despite changes in the voltage output of the power source and changes in ambient temperature.

In this manner, restrictions imposed by prior art constructions on the accuracy of the clock pulse oscillator and on the accuracy of the power sources for electronic apparatus such as electronic table calculators is relieved, thereby increasing the marketability of the thermal printer in accordance with the invention. Further, the method and apparatus in accordance with the invention overcomes a further problem in the prior art arising from variations in the resistance value of the thermal head. This has resulted in rejection of some thermal printing heads due to incompatability with the associated circuitry. The apparatus and method in accordance with the invention permits the use of thermal printing heads characterized by a wide variation in resistance value, the variations being absorbed by adjusting the pulse width or period of the output signal of pulse generator 32 (or 32') at the reference or central voltage $V_r$ according to the average value of the resistance of the exothermic element 34, so as to readily provide a thermal printer with uniform printing quality.

While in the embodiment of FIG. 4, the flip-flop 39 controlled by the output of pulse generator 32 is depicted as a separate element for purposes of explanation, said flip-flop is generally contained within the printer control unit 40. It is also common that the central processing unit 37 and the printer control unit 40 are formed in a unitary integrated circuit chip using large scale integration (LSI) techniques as well known in the art. Oscillator 36 may likewise be included in the LSI chips. In fact, even pulse generator circuit 32 can be incorporated in the chip of central processing unit 37 by selecting a material for the varistor which can be incorporated in an integrated circuit.

It is also noted that while the method and apparatus in accordance with the invention are depicted in connection with a thermal printer associated with an electronic table calculator, the thermal printer in accordance with the invention is equally applicable to other electronic apparatus incorporating thermal printers.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for controlling a thermal printer having a plurality of exothermic printing elements and adapted to be energized for printing by a current pulse produced in response to the output voltage of a power source, comprising driving circuit means for selectively applying driving pulses to said exothermic elements and control circuit means connected for detection of said power source output voltage and operatively coupled to said driving circuit means for adjusting the width of the driving pulses applied to said exothermic printing elements in response to the level of said power source output voltage so that the width of said driving pulses is increased in response to a decrease in said output voltage and is decreased in response to an increase in said output voltage, said control circuit means including a pulse generation circuit operably couplable to receive said power source output voltage for producing an oscillatory signal, said pulse generation circuit including voltage sensitive means including a varistor independent of said plurality of exothermic elements for adjusting the period of said oscillatory signal in response to the level of said output voltage so that the period of said oscillatory circuit is increased in response to a decrease in said output voltage and decreased in response to an increase in said output voltage, said oscillatory signal being applied to said driving circuit means for determining the width of said driving pulses.

2. The apparatus as recited in claim 1, wherein said control circuit means is adapted to detect the ambient temperature in the region of said exothermic printing elements and further adapted to adjust the width of said driving pulses in response to said detected ambient temperature so that the width of said driving pulses increases in response to a decrease in ambient temperature and decreases in response to an increase in ambient temperature.

3. The apparatus as recited in claim 2, including a substrate, said exothermic printing elements being mounted on said substrate, said control circuit means including a temperature sensitive means mounted on said substrate for detecting said ambient temperature.

4. The apparatus as recited in claim 1, wherein said control circuit means includes constant voltage element means and circuit means for detecting the difference voltage between said power source output voltage and a predetermined voltage of said constant voltage element means, said control circuit means being adapted to adjust the width of the driving pulses applied to said exothermic printing element in response to said output voltage by directly responding to said difference voltage so that the rate of change of the width of said driving pulses relative to the rate of change of said output voltage is increased relative to the rate of change in the width of said driving pulses which would result from adjustment of said driving pulse width directly in response to said output voltage.

5. The apparatus as recited in claim 4, wherein said constant voltage element means is a Zener diode.

6. A method for driving an exothermic printing element by means of a voltage source the output voltage of which may vary and wherein printing is effected on a heat sensitive paper by a paper advance means comprising providing a plurality of exothermic printing elements; selectively applying a pulse of current to selected of said exothermic printing elements sufficient to elevate the temperature of said selected exothermic printing elements to a printing temperature to define a predetermined character; detecting the output voltage of said power source; adjusting the pulse width of said driving current pulse in response to variations in the output voltage of said voltage source so as to narrow said pulse width in response to increases in output voltage and widen said pulse width in response to decreases in output voltage; selectively applying driving pulses to said paper advance means to effect advancement of said paper; and adjusting the pulse width of said paper advance driving pulses in response to said detected output voltage so that the width of the paper advance driving pulses is widened in response to a lowering of the output voltage of the power source and narrowed in response to an increase in the output voltage of the power source.

7. The method as recited in claim 6, including the further steps of detecting the ambient temperature in the region of said exothermic elements; and further adjusting said pulse width in response to said detected temperature so that said pulse width is narrowed in response to an increase in ambient temperature and widened in response to a decrease in ambient temperature.

8. The method as recited in claim 7, wherein said exothermic printing elements are mounted on a substrate, said ambient temperature being detected on said substrate.

9. The method as recited in claim 6, including the step of detecting a difference voltage representative of the difference between the output voltage of said power source and a predetermined voltage, said pulse width of said driving current pulse being adjusted in response to said difference voltage so that the pulse width will change a greater amount than if the pulse width is adjusted directly in response to said output voltage of said voltage source.

10. An apparatus for controlling a thermal printer having at least one exothermic printing element and adapted to be energized for printing by a current pulse produced in response to the output voltage of a power source, said thermal printer being adapted to effect printing on temperature sensitive paper and including paper advance means, comprising driving circuit means for selectively applying driving pulses to said exothermic elements; control circuit means connected for detection of said power source output voltage and operatively coupled to said driving circuit means for adjusting the width of the driving pulses applied to said exothermic printing elements in response to the level of said power source output voltage so that the width of said driving pulses is increased in response to a decrease in said output voltage and is decreased in response to an increase in said output voltage, said driving circuit means being further adapted to selectively apply driving pulses to said paper advance means to effect advancement thereof, said control circuit means being further adapted to adjust the width of said paper advance means driving pulses in response to the level of said output voltage of said power source so that the width of said paper advance means driving pulse is increased in response to a decrease in said output voltage and decreased in response to an increase in said output voltage.

11. An apparatus for controlling a thermal printer having at least one exothermic printing element and adapted to be energized for printing by a current pulse produced in response to the output voltage of a power source, comprising driving circuit means for selectively applying driving pulses to said exothermic elements and control circuit means connected for detection of said power source output voltage and operatively coupled to said driving circuit means for adjusting the width of the driving pulses applied to said exothermic printing elements in response to the level of said power source output voltage so that the width of said driving pulses is increased in response to a decrease in said output voltage and is decreased in response to an increase in said output voltage, said control circuit means including a pulse generation circuit operably couplable to receive said power source output voltage for producing an oscillatory signal, said pulse generation circuit including voltage sensitive means including a varistor for adjusting the period of said oscillatory signal in response to the level of said output voltage so that the period of said oscillatory circuit is increased in response to a decrease in said output voltage and decreased in response to an increase in said output voltage, said oscillatory signal being applied to said driving circuit means for determining the width of said driving pulses, said pulse generation circuit further including a free-running multivibrator circuit means having first and second R-C circuit means for controlling the period of oscillation thereof, one of said first and second R-C circuit means including said varistor.

12. The apparatus as recited in claim 11, including temperature sensitive resistive means the resistance of which varies with ambient temperature in the region of said exothermic printing element, one of said first and second R-C circuit means including said temperature sensitive resistive means so that the period of the oscillatory signal of said pulse generation circuit means increases in response to a decrease in detected ambient temperature and decreases in response to an increase in detected ambient temperature.

13. The apparatus as recited in claim 11, wherein said free-running multivibrator circuit means includes a pair of power terminals, said pulse generation circuit means including a constant voltage element means, said free-running multivibrator circuit means being connected in series with said constant voltage element means to receive said power source output voltage across said series connection, the period of said oscillatory circuit being adjusted in response to a difference voltage between said output voltage and the constant voltage of said constant voltage element means.

14. The apparatus as recited in claim 13, including temperature sensitive resistive means in said series connection and adapted to detect the ambient temperature in the region of said exothermic printing element, the period of said oscillatory signal of said pulse generation circuit means being adjusted by said temperature sensitive resistive means so that said period is increased in response to a decrease in ambient temperature and decreased in response to an increase in ambient temperature.

* * * * *